United States Patent [19]

McPeak et al.

[11] Patent Number: 4,759,106

[45] Date of Patent: Jul. 26, 1988

[54] METHOD FOR KNITTING AND SEPARATING GARMENT PIECES

[75] Inventors: David F. McPeak; Jerry W. Hicks, both of Mt. Airy, N.C.

[73] Assignee: Quality Mills, Inc., Mount Airy, N.C.

[21] Appl. No.: 100,401

[22] Filed: Sep. 24, 1987

Related U.S. Application Data

[62] Division of Ser. No. 915,411, Oct. 6, 1986, Pat. No. 4,722,121.

[51] Int. Cl.[4] ..... D06H 7/22

[52] U.S. Cl. ..... 28/168

[58] Field of Search ..... 28/168, 170; 66/147

[56] References Cited

U.S. PATENT DOCUMENTS

| | | | |
|---|---|---|---|
| 2,437,735 | 3/1948 | Getaz | 66/147 |
| 2,529,541 | 11/1950 | Crawley | 66/147 X |
| 2,969,580 | 1/1961 | Wyner | 66/147 X |
| 3,945,096 | 3/1976 | Miranker | 28/168 |

FOREIGN PATENT DOCUMENTS

| | | | |
|---|---|---|---|
| 2065187 | 11/1972 | Fed. Rep. of Germany | 28/168 |
| 2716580 | 10/1977 | Fed. Rep. of Germany | 28/168 |
| 2653227 | 5/1978 | Fed. Rep. of Germany | 28/168 |
| 2702112 | 7/1978 | Fed. Rep. of Germany | 28/170 |
| 2708806 | 10/1978 | Fed. Rep. of Germany | 28/168 |
| 634913 | 3/1950 | United Kingdom . | |

*Primary Examiner*—Robert R. Mackey
*Attorney, Agent, or Firm*—B. B. Olive

[57] ABSTRACT

Fabric made up of a series of knitted collars, sleeve bands, bottom bands, plackets, or the like, intended for use on knitted sport shirts, blouses, and the like, and held together by a separator thread with a relatively high melting point is separated by means of gradually heating the fabric to near the melting point of the separator thread and then to the melting point while holding the fabric under tension.

5 Claims, 2 Drawing Sheets

METHOD FOR KNITTING AND SEPARATING GARMENT PIECES

CROSS-REFERENCE TO RELATED APPLICATON

This is a division of application Ser. No. 06/915,411 filed Oct. 6, 1986 for: APPARATUS FOR KNITTING AND SEPARATING KNITTED GARMENT PIECES now U.S. Pat. No. 4,722,121.

TECHNICAL FIELD

The invention relates generally to knitted fabrics and their method of manufacture. More specifically, the invention is directed to a method and apparatus for knitting and subsequently separating fabric pieces intended to be used as collars, sleeve bands, bottom bands, plackets, and the like, for knit shirts, knit blouses, or other garments.

BACKGROUND ART

While generally applicable to a variety of knit pieces formed for use as part of a garment such as collars, sleeve bands, bottom bands and plackets, the invention will be explained in reference to collars. Those skilled in the art will immediately see the application to knitting and separating other types of garment pieces such as sleeve bands, bottom bands and plackets.

The collar for a knit shirt or knit blouse is typically formed as an individual collar as part of a series of interconnected collars knit on a flat bed machine either from dyed yarns or non-dyed yarns. In the case of yarn-dyed collars, it is known to use a separator thread which melts at a relatively low temperature, e.g., 140° Fahrenheit, to connect the individual collars and separate the collars by use of relatively low temperature steam to melt the so-called "low temperature separator thread". However, the use of the low temperature separator thread technique is not practical for piece-dyed goods since piece-dyed goods have to be dried at a temperature substantially higher than the melting point of the conventional low temperature separator thread.

Piece-dyed collars are typically separated from the strip of collars by manually removing a relatively "high temperature separator thread" which does not melt during drying of the piece-dyed goods. The manually separated thread method is slow, expensive and introduces loose thread which intertangle and distort the fabric during processing. Also, collar fabric having separator threads intended to be manually separated are not compatible with pad batch dyeing because of the loose thread tending to interfere with the dyeing process. Pad batch dyeing on the other hand involves less cost and less abrasion of the fabric. Thus, there is a need for an improved method for knitting piece-dyed collars and for separating such piece-dyed collars and similar garment pieces in a manner which is compatible with conventional drying techniques for piece-dyed goods and also with the pad batch dyeing technique associated with such goods.

There has been a prior attempt to use a separator thread for connecting the collars with a separator thread having a relatively high melting temperature. Such high temperature separator thread technique has been used with low pressure steam and a relatively short infrared heat source but without success. What is more specifically needed therefore and which become objects of the invention is an improved method for knitting collars and similar garment pieces with a separator thread having a relatively high melting temperature and an improved apparatus and method for separating the collars and similar garment pieces connected by the high temperature separator thread so as to be compatible with the requirements of piece-dyed goods and pad batch dyeing and so as to substantially eliminate the need for manual separation.

DISCLOSURE OF INVENTION

Collars will continue to be used as an example of the garment pieces to which the invention applies. Using such example, the apparatus and method of the invention are based on connecting the individual collars during knitting with a separator thread having a relatively high melting point, e.g. about 240° Fahrenheit, then moving the fabric while under tension beneath a source of heat which tends to gradually raise the fabric temperature to near the separator thread's melting point followed by application of enough heat to cause the separator thread to separate and shrink into the fabric. As the separated collars leave the invention apparatus, a stream of relatively cool air reduces the temperature of the fabric for subsequent handling and a minor manual trimming operation for removing body thread connecting one collar to the next. While infrared heaters are disclosed as the source of establishing the heat gradient, it is recognized that a gas fired heater, a hot air source or other radiant heat source would accomplish the same result.

BEST MODE FOR CARRYING OUT THE INVENTION

Figures 1, 2:
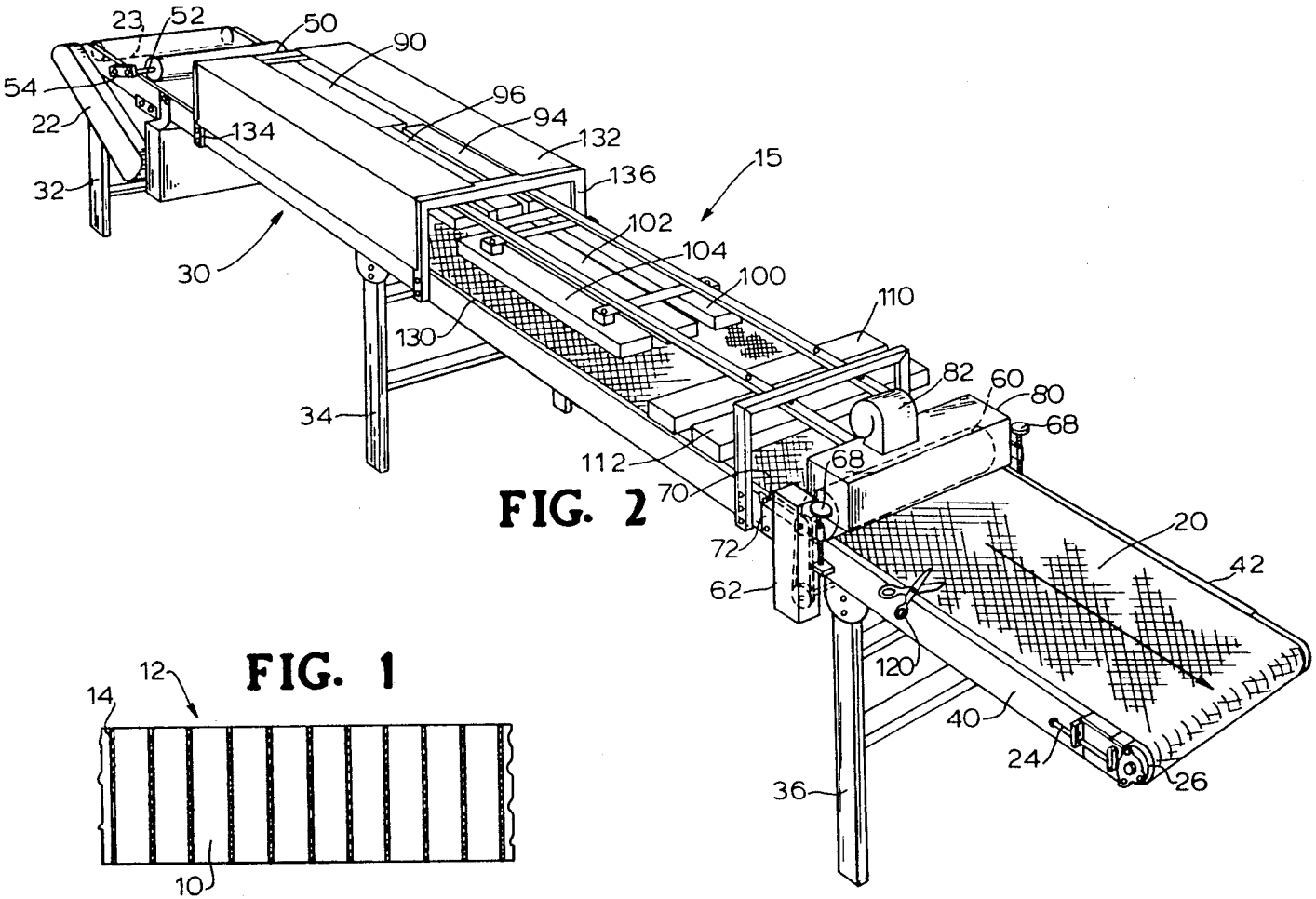
FIG. 1 illustrates a strip of knit fabric made up of a series of collars connected together by a separator thread having a relatively high melting temperature according to the invention.
FIG. 2 is a perspective view of an apparatus for practicing the collar separation method of the invention.

Making reference to the drawings, the collar, being used as an example of a garment piece to which the invention applies, for a knit shirt or knit blouse prior to being attached to the neck opening of the knit shirt or blouse is typically knit as an individual collar 10 forming part of a series of interconnected collars 12 as somewhat schematically illustrated in FIG. 1. According to the invention, each individual collar is connected to adjoining collars by what is referred to as a separator thread shown in exaggerated form as separator thread 14 in FIG. 1. Even though indicated as a visible thread in FIG. 1, such separator thread in normal practice is substantially invisible because of its relatively small size and the manner in which it is knit into the body fabric.

According to the invention, separator thread 14 has a relatively high melting point, e.g., about 240° Fahrenheit and substantially below the melting point of the body thread forming each individual collar 10. A cotton body thread is assumed to be used by way of example. The method and apparatus of the invention are thus directed to providing both a method and an apparatus whereby the individual collars 10, or other applicable garment piece, can be separated one from the other by melting the relatively high temperature thread 14 joining the collars 10. In general, the method which has been found successful requires that the strips of collar fabric 12 be gradually increased in temperature while being advanced under tension on a conveyor before reaching a source of temperature sufficient to bring the separator thread 14 to its melting point and thereby allow each of the individual collars 10 to separate. How this is accomplished both from a method and apparatus viewpoint is next explained.

Figure 3:
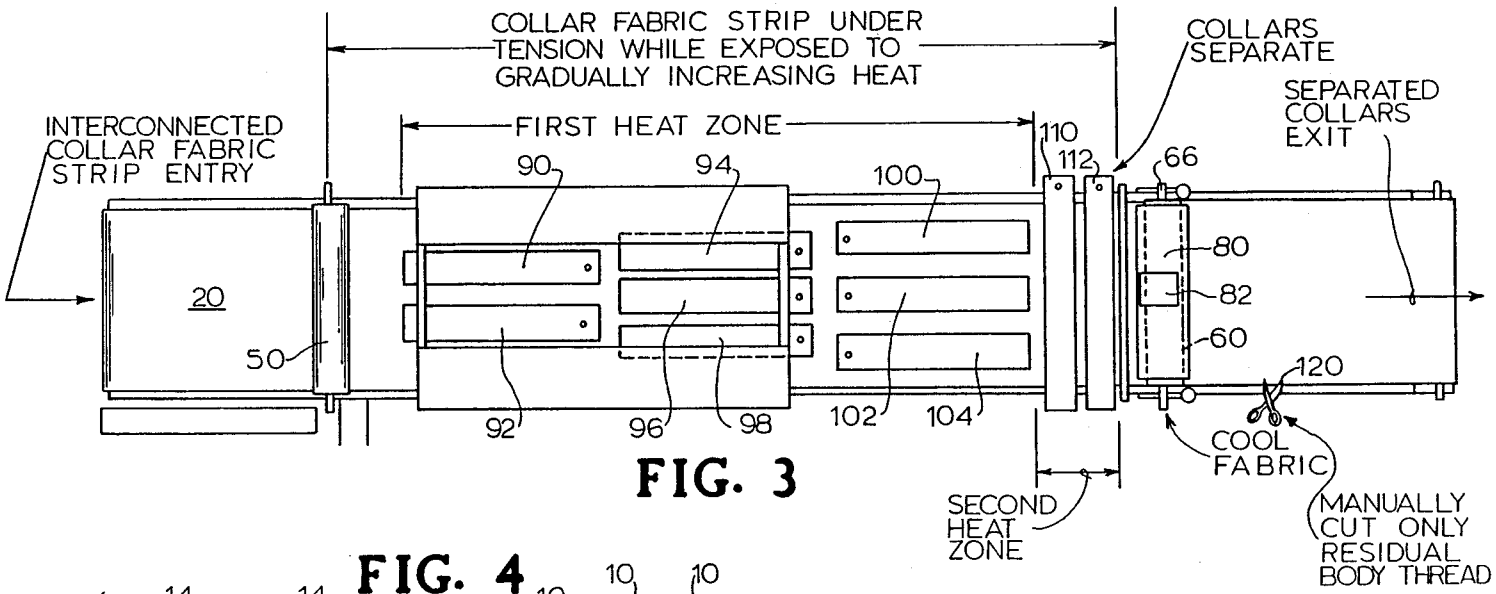
FIG. 3 is a plan view of the apparatus illustrated in FIG. 2 with various parts eliminated for purposes of illustration.

As illustrated in FIGS. 2 and 3, the invention apparatus 15 includes a flat conveyor belt 20 which is driven through a suitably housed adjustable speed motor-chain drive 22 and drive roller 23 and is tensioned by means of tensioning screws 24 which control the position of the tensioning roller 26 over which belt 20 passes. Belt 20 is preferably formed from a highly heat resistant flexible synthetic fabric suited to transporting the collar fabric 12 while being exposed to the heat necessary to raise the body fabric temperature and melt the separator thread 14. An industrial type fiberglass belt rated at 900° Fahrenheit service temperature is suitable for the purpose. Belt 20 is mounted on a frame 30 having suitably spaced pairs of legs 32, 34 and 36 supporting side frame members 40, 42. A freely rotating roller 50 presses the fabric against the belt 20 and mounts on shaft 52 and opposed pivotal arms 54 only one of which is shown in FIG. 2. Roller 50 rotates at a surface speed equal to the conveyor belt speed. Another lengthwise spaced roller 60 spans the width of the conveyor 20 and is driven by a variable speed motor-chain drive 62 connected to the shaft 66 on which roller 60 is mounted. Tensioning screws 68 mounted on pivotal arms 70 supported by uprights 72 are suitably adjusted for raising or lowering roller 60 to accommodate to the thickness of fabric 12 being processed. Roller 60 mounts in a housing 80 on which is mounted an electrically operated air blower 82 for the purpose of forcing cool air on the fabric below roller 60 in order to cool the fabric after the collars 10 have separated. Roller 60 operates at a speed in excess of the conveyor speed sufficient to apply tension to the collar fabric 12 passing on conveyor 20 between rollers 50 and 60. Thus, the fabric 12 is fed into the invention apparatus 15 free of tension but is placed under tension between rollers 50 and 60. The speed of roller 60, the force applied to the fabric by roller 50 and the force applied to the fabric by roller 60 will vary with the nature of the fabric and are selected as required to establish appropriate tension for the purposes of the invention as herein explained.

During transit of the collar fabric 12 between roller 50 and roller 60, it has been discovered to be desirable to first gradually and continuously heat the fabric 12 by means of a pair of spaced-apart lengthwise extending infrared heaters 90, 92. The heat imposed on the fabric 12 by heaters 90, 92 is followed by additional continuous heat imposed by three lengthwise extending infrared heaters 94, 96 and 98. Additional continuous heat is applied by three additional lengthwise extending infrared heaters 100, 102 and 104.

Figure 4:
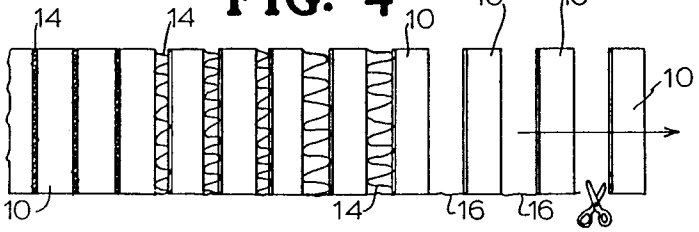
FIG. 4 is a schematic view illustrating how the FIG. 1 strip is gradually heated and the individual collars gradually separated according to the invention.

The exact location, spacing and heat ratings of the mentioned heaters 90, 92, 94, 96, 98, 100, 102, and 104 forming part of the first extended heat zone are selected such that the fabric 12 after passing under the last battery of lengthwise extending heaters 100, 102 and 104 has had its temperature raised to a point near or just slightly below the melting point of the selected high temperature separator thread 14. A suitable gradient can be established by observing suitably selected heat sensitive papers placed on the moving fabric. As the tensioned collar fabric 12 continues to move on conveyor 20, it next passes through a relatively short second heat zone under a pair of crosswise extending continuously operating infrared heaters 110,112 whose location, spacing and heat ratings are designed to rapidly bring the temperature of the already heated fabric 12 up to a temperature effective to cause the separator thread 14 between each pair of collars 10 to physically melt and the collars 10 to separate. As schematically illustrated in FIG. 4, the individual collars 10 begin to separate as the fabric 12 temperature increases. The amount of separation increases as the fabric moves further along the conveyor and such separation can be visually observed until complete separation occurs as the fabric passes under heaters 110,112. The residual portions of the melted separator thread 14 tend to become hidden in the body portion of the fabric. Such final temperature is applied for only a few seconds, e.g., four seconds. As the collar fabric 12 continues to proceed on conveyor 20 and passes beneath roller 60, the fabric is exposed to a blast of cooling air obtained from fan 82 so as to bring the temperature down to a level facilitating handling of the fabric by a pair of operators standing on opposite sides of the exit end of the conveyor 20. At this stage, the collars 10 are joined on one side only by the body thread 16. An operator, not shown, cuts the residual body thread 16 on one side of the fabric 12 as schematically illustrated in FIG. 2 with a pair of scissors 120 which operation is extremely fast and produces a continuing series of collars ready for passing to the next operation. However, it will be noted that even though a hand scissors operation is shown for illustration, the invention method and apparatus readily lends itself to use of an automatic clipper and stacker.

The collar fabric 12 while moving between roller 50 and roller 60 under tension is supported for a portion of its travel on a steel plate 130 which extends below the upper run of conveyor 20 between roller 50 and up to heater 110 but does not extend below heaters 110 and 112. Plate 130 effectively acts as a heat sink in the first heat zone and facilitates a relatively smooth transition of the increasing and continuously applied heat as the collar fabric 12 moves from left to right as seen in FIGS. 2 and 3. Retention of the heat is also facilitated by means of a partially closed cabinet structure 132 supported on a pair of inverted U-shaped arms 134, 136 attached to side frame members 40, 42. While a specific structure has been shown for purposes of illustration, it is recognized that other forms of heat such as gas-fired heaters, hot air sources, and the like, could be employed with other forms of structure. However, what is deemed significant is that the collar fabric 12, or other applicable garment piece, be substantially continuously heated in such manner that the temperature of the fabric where interconnected gradually rises to the melting point of the high temperature separator thread 14. It is also recognized that collar fabric made of cotton being used by way of example is suited to using a separator thread with a melting point, e.g., 240° Fahrenheit, which is substantially less than the melting point of the separator thread that would be required for separating collars in a collar fabric made of a polyester/cotton mix in which the separator thread might, for example, require a higher melting temperature, e.g., 300° Fahrenheit.

It can be seen from the foregoing description that the need for manually removing the separator thread in piece-dyed goods has been eliminated. Rapid separation is achieved with a typical time for heating and separating a collar being in the order of a few seconds. Further, the method and apparatus of the invention permits use of the highly advantageous pad-batch-type dyeing procedure and piece-dyed collar fabric. Also to be noted as an advantage of the invention is that the method and apparatus of the invention is compatible with conventional drying techniques used to dry the fabric immediately prior to the separator thread separation process.

Thus, when the invention method and apparatus is applied to collar fabric made of cotton using a separator thread having a melting point of approximately 240° Fahrenheit, it has been found practical to dry the collar fabric at a temperature of approximately 230° Fahrenheit which satisfactorily avoids any premature separation of the collars in the dryer.

Also noted is that the body fabric with which the collar fabric is ultimately associated is typically required to go through a resin cure involving temperatures in the range of 330° to 350° Fahrenheit. The improved method and apparatus of the invention inherently subjects collars to relatively high temperature and thus it has been discovered that there is an overall improvement in dye match between the collar and the body fabric as an indirect result of the invention. Reduction in labor, space and defective goods have also been achieved.

While explained in connection with collars as an example, it is again mentioned that the invention has application to sleeve bands, bottom bands, plackets and like knit garment pieces.

What we claim is:

1. A method for fabricating and separating knit garment pieces such as collars, bands, plackets, and the like, comprising:

(a) knitting a strip of fabric comprising a series of garment pieces having one edge of each connected to the edge of the next successive piece by a separator thread having a melting point substantially less than the melting point of the body threads from which the pieces are knit:

(b) conveying said strip of fabric uncompressed on a belt conveyor and gradually heating the strip with heating means located above the conveyor while being conveyed through a first zone of extended travel to a temperature less than but near the melting point of the separator thread while maintaining the strip under tension whereby to soften and more fully expose the separator thread;

(c) while maintaining the tension on said strip on said conveyor, heating the strip including the separator thread with heating means located above the conveyor to the melting point of the separator thread while being conveyed through a second zone of short travel forming an extension of said first zone to effect full separation of the pieces and to allow the residual separator thread to shrink within the fabric; and (d) separating any remaining body threads joining the pieces together to provide fully separated pieces for further processing.

2. The method of claim 1 wherein said garment pieces comprise collars.

3. The method of claim 1 including cooling said fabric while on said conveyor after separating said remaining body threads.

4. The method of claim 1 including establishing said tension by stretching said strip of fabric between a first roller which engages and presses the trailing end of said strip of fabric against said conveyor with a resulting surface speed equal to the speed of the conveyor and a second driven roller which engages and presses the leading end of said strip of fabric against said conveyor and rotates with a surface speed exceeding the speed of said conveyor to establish said tension.

5. The method of claim 4 including adjusting said driven roller speed to adjust said tension.

* * * * *